US012408693B2

(12) United States Patent
Sinkinson et al.

(10) Patent No.: US 12,408,693 B2
(45) Date of Patent: Sep. 9, 2025

(54) NICOTINE LIQUID FORMULATION

(71) Applicant: JT International S.A., Geneva (CH)

(72) Inventors: Cecile Sinkinson, Versonnex (FR); Akihiro Kondoh, Geneva (CH)

(73) Assignee: JT International S.A. (CH)

( * ) Notice: Subject to any disclaimer, the term of this patent is extended or adjusted under 35 U.S.C. 154(b) by 818 days.

(21) Appl. No.: 17/605,096

(22) PCT Filed: May 28, 2020

(86) PCT No.: PCT/EP2020/064837
§ 371 (c)(1),
(2) Date: Oct. 20, 2021

(87) PCT Pub. No.: WO2020/239907
PCT Pub. Date: Dec. 3, 2020

(65) Prior Publication Data

US 2022/0183344 A1 Jun. 16, 2022

(30) Foreign Application Priority Data

May 31, 2019 (EP) ..... 19177641

(51) Int. Cl.
*A61K 36/81* (2006.01)
*A24B 15/167* (2020.01)

(52) U.S. Cl.
CPC ..... *A24B 15/167* (2016.11)

(58) Field of Classification Search
None
See application file for complete search history.

(56) References Cited

U.S. PATENT DOCUMENTS

| | | | | |
|---|---|---|---|---|
| 9,215,895 | B2 | 12/2015 | Bowen et al. | |
| 2014/0000638 | A1* | 1/2014 | Sebastian | A24F 40/30 131/328 |
| 2015/0313275 | A1* | 11/2015 | Anderson | A24B 15/10 131/352 |
| 2016/0302471 | A1* | 10/2016 | Bowen | A24B 15/301 |
| 2018/0228214 | A1 | 8/2018 | McAdam et al. | |

FOREIGN PATENT DOCUMENTS

| | | | |
|---|---|---|---|
| CN | 105979805 | A | 9/2016 |
| CN | 107072287 | A | 8/2017 |
| WO | 2018122375 | A1 | 7/2018 |

OTHER PUBLICATIONS

International Search Report for Application No. PCT/EP2020/064837, dated Jul. 31, 2020, 3 pages.

* cited by examiner

*Primary Examiner* — Russell G Fiebig
(74) *Attorney, Agent, or Firm* — Lerner David LLP

(57) ABSTRACT

A nicotine liquid formulation provides an improved sensory experience. Electronic cigarette cartridges including the nicotine liquid formulation, the use of the nicotine liquid formulation or the electronic cigarette cartridge in an electronic cigarette, electronic cigarettes including the nicotine liquid formulation or the electronic cigarette cartridge, and a method of generating an inhalable aerosol including using an electronic vaporization device having the nicotine liquid formulation are also provided.

19 Claims, 3 Drawing Sheets

NICOTINE LIQUID FORMULATION

CROSS-REFERENCE TO RELATED APPLICATIONS

The present application is a national phase entry under 35 U.S.C. § 371 of International Application No. PCT/EP2020/064837, filed May 28, 2020, published in English, which claims priority to European Application No. 19177641.8 filed May 31, 2019, the disclosures of which are incorporated herein by reference.

FIELD OF THE INVENTION

The present invention relates to nicotine liquid formulation with improved sensory experience, electronic cigarette cartridges comprising said nicotine liquid formulation, the use of said nicotine liquid formulation or said electronic cigarette cartridge in an electronic cigarette, electronic cigarettes comprising said nicotine liquid formulation or said electronic cigarette cartridge, and a method of generating an inhalable aerosol comprising using an electronic vaporization device comprising said nicotine liquid formulation.

BACKGROUND OF THE INVENTION

There is a high demand to provide nicotine liquid formulations with improved sensory experience of inhaling vapor and thus, providing an enhanced user satisfaction.

Electronic cigarettes (or "e-cigarettes") have been developed as an alternative to traditional cigarettes as a means for volatizing active components, such as nicotine, for inhalation without combustion, while at the same time providing the user with an oral experience similar to that of traditional cigarette smoking.

Nicotine liquid formulations are a popular cigarette substitute product. The formulations usually comprise next to nicotine further components such as solvents, thickening agents, stabilizing agents, flavoring and/or taste regulators U.S. Pat. No. 9,215,895 describes nicotine liquid formulations in which carboxylic acids such as benzoic acid are used in combination with nicotine thereby forming nicotine salts. As described in U.S. Pat. No. 9,215,895 it is important to use a sufficient amount of acid to fully associate with the nicotine molecules. For example, U.S. Pat. No. 9,215,895 explains that 1 mole of nicotine produces a salt with 2 moles of pyruvic acid and therefore the formulation containing nicotine pyruvate (1:2) may deliver more satisfaction to the user than the one containing the same amount of nicotine but only half the amount of pyruvic acid, i.e. nicotine pyruvate (1:1). Benzoic acid produces a salt with one mole of benzoic acid and 1 mole of nicotine and hence U.S. Pat. No. 9,215,895 proposes that the formulation should contain an equimolar ratio of nicotine to benzoic acid.

When using an equimolar ratio of acid to nicotine, or a ratio greater than equimolar, e.g. 2:1 for acids such as pyruvic acid, to fully associate with the nicotine molecules, the overall pH of the e-liquid is considerably reduced to below 7. The pH of an e-liquid of 18 mg/ml formulated with benzoic acid and nicotine with equimolar ratio is within a range of 5 to below 6. This pH range provides a pleasant flavour perception and taste satisfaction.

However, the inventors of the present invention have found out that the overall sensorial experience of inhaling vapour is not only created by the taste satisfaction, but the sensorial effect often referred to amongst discerning adult vapers as "throat sensation" and "initial" or "later" nicotine impact has a significant influence on the sensorial experience.

Therefore, in view of the nicotine liquid formulations known in the prior art there is a need for providing formulations with enhanced sensorial experience which provide an improved taste satisfaction with less bitter taste with an improved throat sensation and nicotine impact. Further, there is a need for providing formulations with different taste and aroma notes which provide an improved taste satisfaction and flavour experience.

Further, if nicotine liquid formulations are sold as a stand-alone product, e.g. as a container containing the nicotine liquid formulation, then it is not known with which device the user will use the nicotine liquid formulation. Some devices which will be used with the nicotine liquid formulation may contain components that can be adversely affected by free-acid contained in a nicotine liquid formulation. E.g. components of the device might be damaged or undesirable compounds might be generated in the vapor produced by the device.

Therefore, there is a need to provide a nicotine liquid formulation that can be used universally with different devices, thereby avoiding the risk of adversely affecting the device by the nicotine liquid formulation; avoiding damaging devices which may contain components that can be adversely affected by free-acid contained in the nicotine liquid formulation; and minimizing the risk of such acid reacting negatively with any such components in a device which can be adversely affected by acidic liquids.

SUMMARY OF THE INVENTION

The inventors have found out that the sensorial experience of inhaling the vapour is related to the pH of the nicotine liquid formulation, in combination with the presence of free-base nicotine.

They have surprisingly found that using a reduced molar ratio of acid to nicotine of about 0.5-0.85 for nicotine liquid formulations having nicotine concentrations of 12 mg/ml and greater provides an improved formulation in which the pH typically associated with high nicotine strength concentration is reduced to a level in the range from about 6 to 8, providing an enhanced taste satisfaction with less bitter taste without reducing the sensorial impact of the free base nicotine, thereby providing a satisfying throat sensation and nicotine impact. Such a nicotine liquid formulation provides surprisingly an enhanced sensorial experience.

Hence, according to a first aspect of the present invention a nicotine liquid formulation is provided comprising nicotine and a primary acid or a mixture of primary acids in a liquid carrier, wherein the nicotine concentration in the nicotine liquid formulation is 12 mg/ml or above, the primary acid is preferably an organic acid and comprises at least a carboxylic acid, and the molar ratio of the primary acid or mixture of primary acids to the nicotine in the nicotine liquid formulation is in the range of 0.5:1.0 to 0.85:1.0.

According to a second aspect the present invention provides a nicotine liquid formulation comprising nicotine and a primary acid or a mixture of primary acids in a liquid carrier, wherein the nicotine concentration in the nicotine liquid formulation is 12 mg/ml or above, the primary acid is preferably an organic acid and comprises at least a carboxylic acid, and the nicotine liquid formulation has a pH value in the range from 6 to 8.

According to a third aspect the present invention provides an electronic cigarette cartridge comprising the nicotine liquid formulation according to the first or second aspect.

According to a fourth aspect the present invention provides the use of the nicotine liquid formulation according to the first or second aspect or the use of the electronic cigarette cartridge according to the third aspect in an electronic cigarette.

According to a fifth aspect the present invention provides an electronic cigarette comprising the nicotine liquid formulation according to the first or second aspect or the electronic cigarette cartridge according to the third aspect.

According to a sixth aspect the present invention provides a method of generating an inhalable aerosol comprising nicotine for delivery to a user comprising using an electronic vaporization device comprising a nicotine liquid formulation and a heater, wherein the nicotine liquid formulation is a nicotine liquid formulation according to the first or second aspect, the method comprising (i) providing an amount of the nicotine liquid formulation to the heater; and (ii) forming an aerosol by heating the amount of the nicotine liquid formulation.

According to a seventh aspect the present invention provides a mousse comprising a tobacco ingredient containing agent and/or an inhalable agent, an aerosol forming agent, a foam stabilizing agent, and a foam forming agent, wherein the weight of the tobacco ingredient containing agent and/or the inhalable agent is 0.1-33 wt.-% of the weight of the foam, and the weight of the aerosol forming agent is 10-70 wt.-% of the weight of the foam, wherein the tobacco ingredient containing agent and/or an inhalable agent includes a nicotine liquid formulation according to the first or second aspect.

According to an eighth aspect the present invention provides a consumable item comprising a non-woven fibrous material (e.g. paper made from cellulose fibers or reconstituted tobacco fibers), wherein the non-woven fibrous material includes a nicotine liquid formulation according to the first or second aspect.

An advantage of the nicotine liquid formulations according to aspects of the present invention is that the nicotine liquid formulations can be used universally with different devices, thereby avoiding the risk of adversely affecting the device by the nicotine liquid formulation. In particular if the nicotine liquid formulation is sold as a stand-alone product, e.g. as a container containing the nicotine liquid formulation, then it is not known with which device the user will use the nicotine liquid formulation. Some devices which will be used with the nicotine liquid formulation may contain components that can be adversely affected by free-acid contained in the nicotine liquid formulation. E.g. components of the device might be damaged or undesirable compounds might be generated in the vapor produced by the device. Embodiments in which the pH is maintained in the range from 6-8 and/or in which there is a molar excess of nicotine compared to acid provide the advantage that there is a significantly reduced amount of free acid in the e-liquid solution at any period in time compared to known nicotine liquid formulations having a pH of below 6 and with a molar ratio of acid:nicotine of 1:1. This in turn minimizes the risk of such acid reacting negatively with any such components in a device which can be adversely affected by acidic liquids, e.g. certain metals might be corroded by acids.

DETAILED DESCRIPTION

Definitions

Figure 1:
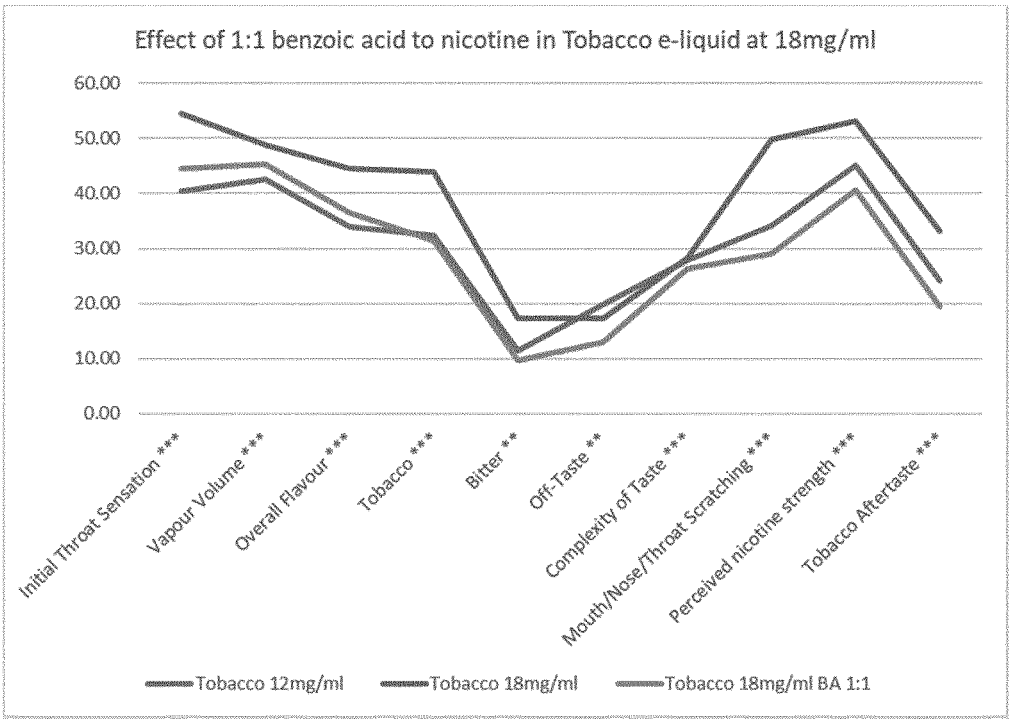
FIG. 1: Effect of benzoic acid (1:1 molar ratio acid to nicotine) on the sensory profile of tobacco flavor e-liquid at 18 mg/ml

The term "organic acid" as used herein, refers to an organic compound with acidic properties (e.g., by Brønsted-Lowry definition, or Lewis definition). Carboxylic acids are a common group of organic acids. The acidity of carboxylic acids is associated with their carboxyl group —COOH. A dicarboxylic acid possesses two carboxylic acid groups. The relative acidity of an organic acid is measured by its pKa value and one of skill in the art knows how to determine the acidity of an organic acid based on its given pKa value. The term "keto acid" as used herein, refers to organic compounds that contain a carboxylic acid group and a ketone group. Common types of keto acids include alpha-keto acids, or 2-oxoacids, such as pyruvic acid or oxaloacetic acid, having the keto group adjacent to the carboxylic acid; beta-keto acids, or 3-oxoacids, such as acetoacetic acid, having the ketone group at the second carbon from the carboxylic acid; gamma-keto acids, or 4-oxoacids, such as levulinic acid, having the ketone group at the third carbon from the carboxylic acid.

Nicotine Liquid Formulation

In the following the first aspect of the present invention is disclosed. A nicotine liquid formulation according to certain embodiments comprises nicotine and a primary acid or a mixture of primary acids in a liquid carrier, wherein the nicotine concentration in the nicotine liquid formulation is 12 mg/ml or above, the primary acid or mixture of primary acids comprises at least a carboxylic acid, and the molar ratio of the primary acid or mixture of primary acids to the nicotine in the nicotine liquid formulation is in the range of 0.5:1.0 to 0.85:1.0.

The nicotine liquid formulation comprises a primary acid or a mixture of primary acids. The primary acid is preferably an organic acid. The primary acid or mixture of primary acids comprises at least a carboxylic acid. The carboxylic acid is not particularly restricted and a person skilled in the art can use any carboxylic acid suitable for use in a nicotine liquid formulation. Preferably the carboxylic acid is at least one acid selected from the list consisting of Benzoic acid, Levulinic acid, D/L-Tartaric acid, Capric acid, Pyruvic acid, Citric acid, Fumaric acid, D/L-Lactic acid, D/L-Matic acid, Sorbic acid, Adipic acid, L-Aspartic acid, L-Glutamic acid, Succinic acid, Gluconic acid, Linoleic acid, Saccharic acid, 3,7 dimethyl-6-octenoic acid, 2-methyl pentanoic acid, trans-2-Hexenoic acid, Caprylic acid, Lauric acid, Stearic acid, Butyric acid, Linolenic acid, Malonic acid, Myristic acid, Oleic acid, Palmitic acid, Phenylacetic acid, Propionic acid, Valeric acid, Decanoic acid, Hexanoic acid, Octanoic acid. More preferably the carboxylic acid is at least one acid selected from the list consisting of Benzoic acid, Levulinic acid, DL-Tartaric acid, Capric acid, Pyruvic acid, Citric acid, Fumaric acid, DL-Lactic acid, DL-Malic acid, Sorbic acid, Adipic acid, L-Aspartic acid, L-Glutamic acid, Succinic acid, Gluconic acid, Linoleic acid, Saccharic acid, 3,7 dimethyl-6-octenoic acid, 2-methyl pentanoic acid, trans-2-Hexenoic acid.

The nicotine concentration in the nicotine liquid formulation is 12 mg/ml or above. The nicotine liquid formulation has preferably a nicotine concentration in the range of 12 mg/ml to 40 mg/ml, preferably 12 mg/ml to 35 mg/ml, more preferably 12 mg/ml to 30 mg/ml, more preferably 12 mg/ml to 25 mg/ml, more preferably 12 mg/ml to 20 mg/ml, even more preferably 12 mg/ml to 19 mg/ml, even more preferably 12 and 18 mg/ml most preferably 18 mg/ml.

The molar ratio of the primary acid or the mixture of primary acids to the nicotine in the nicotine liquid formulation is in the range of 0.5:1.0 to 0.85:1.0. Preferably, the molar ratio of the primary acid or the mixture of primary acids to the nicotine in the nicotine liquid formulation is in the range of 0.55:1.0 to 0.8:1.0, more preferably 0.6:1.0 to 0.75:1.0, even more preferably 0.65:1.0 to 0.7:1.0. By adjusting the molar ratio of the primary acid or the mixture of primary acids to the nicotine in the nicotine liquid formulation to said range the nicotine base is not completely neutralized by the used primary acid or the mixture of primary acids, but there is still free nicotine base remaining in the nicotine liquid formulation. As a result, it is possible to provide a nicotine liquid formulation with enhanced sensorial experience providing an improved taste satisfaction with less bitter taste with an improved throat sensation and nicotine impact. Further, it is possible to provide a nicotine liquid formulation that can be used universally with different devices, thereby avoiding the risk of adversely affecting the devise by the nicotine liquid formulation, in particular minimizing the risk that free acid reacts negatively with any components in a device which can be adversely affected by acidic liquids.

The nicotine liquid formulation comprises nicotine and a primary acid or a mixture of primary acids in a liquid carrier. The liquid carrier is not further limited and any suitable medium in which the other compounds of the nicotine liquid formulation are soluble at ambient conditions, can be used. Examples include, but are not limited to, glycerol, propylene glycol, trimethylene glycol, water, ethanol and the like, as well as combinations thereof. In some embodiments, the liquid carrier comprises 0% to 100% of propylene glycol and 100% to 0% of glycerol, preferably vegetable glycerol. In some embodiments, the liquid carrier comprises 0% to 100% of propylene glycol and 100% to 0% of glycerol. In some embodiments, the liquid carrier comprises 10% to 70% of propylene glycol and 90% to 30% of glycerol. In some embodiments, the liquid carrier comprises 20% to 50% of propylene glycol and 80% to 50% of glycerol. In some embodiments, the liquid carrier comprises 30% propylene glycol and 70% glycerol. Preferably, the glycerol used is vegetable glycerol.

In a preferred embodiment the liquid carrier is formed of vegetable glycerol or a mixture of vegetable glycerol and propylene glycol, most preferably in any ratio of glycerol to propylene glycol from 100:0 to 40:60. The liquid carrier is preferably a mixture of vegetable glycerol and propylene glycol in a mixture of 100:0, more preferably 90:10, even more preferably 80:20, even more preferably 70:30 and even more preferably 60:40, even more preferably 50:50 and most preferably and 40:60.

Additionally, the nicotine liquid formulation can comprise water. For example, because of the hygroscopic nature of e.g. glycerol the solution may contain small amounts of water absorbed from the atmosphere, e.g. up to about 5 wt. %, more likely between 1-3 wt. %.

In some embodiments of the nicotine liquid formulation the primary acid or the mixture of primary acids is a mixture which comprises a primary acid, which is preferably an organic acid, most preferably a carboxylic acid and further comprises a secondary acid or a mixture of secondary acids.

The secondary acid or mixture of secondary acids is not particularly restricted and a person skilled in the art can use any acid suitable for the use in a nicotine liquid formulation. Preferably, the secondary acid or mixture of secondary acids is or includes an organic acid. Furthermore, the secondary acid or mixture of secondary acids may be or include an inorganic acid, such as phosphoric acid, suitable for human consumption, provided that the total amount of such secondary acid is relatively small compared to the amount of the primary acid or mixture of primary acids, e.g. less than 50% by volume of the amount of primary acid or mixture of primary acids and more preferably less than 20% and most preferably less than 10% by volume of the amount of primary acid or mixture of primary acids. Preferably, the secondary acid or mixture of secondary acids is at least one acid selected from the group consisting of Benzoic acid, Levulinic acid, DL-Tartaric acid, Caprylic acid, Caproic acid, Capric acid, Lauric acid, Stearic acid, Pyruvic acid, Citric acid, Acetic acid, Oxalic acid, Butyric acid, Fumaric acid, DL-Lactic acid, Phosphoric acid, DL-Malic acid, Sorbic acid, Adipic acid, Ascorbic acid, L-Aspartic acid, L-Glutamic acid, Formic acid, Succinic acid, Gluconic acid, Linolenic acid, Linoleic acid, Malonic acid, Myristic acid, Oleic acid, Palmitic acid, Phenylacetic acid, Propionic acid, Saccharic acid, Salicylic acid, Valeric acid. Most preferably, the secondary acid or mixture of secondary acids is at least one acid selected from the group consisting of Stearic acid, Fumaric acid, Adipic acid, L-Aspartic acid, Gluconic acid, Linolenic acid, Linoleic acid, Malonic acid, Saccharic acid, Salicylic acid.

Adding one or more secondary acids to the primary used acid can provide an enhanced sensorial satisfaction for certain flavours or flavour-types of e-liquid formulation. This can be flavour dependent and in particular different secondary acids are useful with different flavours or flavour types. For example, the use of citric acid as a secondary acid is found to be particularly beneficial when used with fruit flavours or flavours including a significant fruit flavour component.

In an exemplary embodiment at least one secondary acid selected from the group comprising levulinic acid, oxalic acid, butyric acid, and tartaric acid is added to a nicotine liquid formulation in addition to the main carboxylic acid to enhance sensorial satisfaction of the nicotine liquid formulation. The use of these secondary acids is found to be particularly useful with tobacco flavours and flavours which include a significant tobacco flavour component.

In a further exemplary embodiment, at least one secondary acid selected from the group comprising citric acid, acetic acid, ascorbic acid, tartaric acid, fumaric acid, lactic acid and malic acid is added to the nicotine liquid formulation in addition to the main carboxylic acid to enhance sensorial satisfaction of the nicotine liquid formulation. The use of these secondary acids is found to be particularly beneficial when used with fruit flavours and flavours which include a significant fruit flavour component.

In a further exemplary embodiment, at least one secondary acid selected from the group comprising linolenic acid, linoleic acid and tartaric acid is added to the nicotine liquid formulation in addition to the primary acid or mixture of primary acids to enhance sensorial satisfaction of the nicotine liquid formulation. The secondary acid or mixture of secondary acids is added in an amount so that the weight ratio of the total amount of the secondary acid(s) to the total amount of the primary acid or mixture of primary acids is preferably about 0.1:0.9 to 0.5:0.5, more preferably from about 0.1:0.9 to 0.4:0.6, even more preferably from about 0.2:0.8 to 0.3:0.7, most preferably about 0.2:0.8.

The inventors of the present invention have found out that adding secondary acids such as linolenic acid, linoleic acid and/or tartaric acid to the primary acid or mixture of primary acids, in particular at a weight ratio of about 0.2:0.8, surprisingly enhances the taste satisfaction of tobacco flavour nicotine liquid formulations having a nicotine concentration of 12 mg/ml and above.

Adding secondary acids such as adipic acid and/or salicylic acid to the primary acid or mixture of primary acids surprisingly enhances the taste satisfaction of menthol flavour nicotine liquid formulations.

Adding secondary acids such as saccharic acid, malonic, and/or gluconic acid to the primary acid or mixture of primary acids surprisingly enhances the taste satisfaction of fruity and dessert-like flavour nicotine liquid formulations.

Adding at least one secondary acid to the primary acid or mixture of primary acids provides nicotine liquid formulations with different taste and aroma notes thereby providing enhanced sensorial experience and improved taste satisfaction and flavour experience.

The nicotine liquid formulations described herein can comprise other suitable components used for nicotine liquid formulations, such as flavourants, carriers, stabilizers, diluents, dispersing agents, suspending agents, thickening agents, and/or excipients.

In the following a second aspect of the invention is described. A second aspect of the present invention provides a nicotine liquid formulation comprising nicotine and a primary acid or a mixture of primary acids in a liquid carrier, wherein the nicotine concentration in the nicotine liquid formulation is 12 mg/ml or above, the primary acid or mixture of primary acids comprises at least a carboxylic acid, and the nicotine liquid formulation has a pH value in the range from 6 to 8.

By adjusting the pH value of the nicotine liquid formulation to said range, the sensorial experience of nicotine liquid formulations with a nicotine concentration of 12 mg/ml or above can be enhanced. Further, it is possible to provide a nicotine liquid formulation that can be used universally with different devices, thereby avoiding the risk of adversely affecting the devise by the nicotine liquid formulation, in particular minimizing the risk that free acid reacts negatively with any components in a device which can be adversely affected by acidic liquids.

In one preferred embodiment, the nicotine liquid formulation according to the second aspect has a pH value in the range from 6 to 7, preferably 6.2 to 6.8, more preferably 6.3 to 6.5. Adjusting the pH value of the nicotine liquid formulation to that range enhances the sensorial experience of the nicotine liquid formulation. Nicotine formulations having pH values in these ranges are found to be particularly beneficial when used with fruit flavours and flavours which include a significant fruit flavour component.

In another preferred embodiment, the nicotine liquid formulation according to the second aspect has a pH value in the range from 7 to 8, preferably 7.2 to 7.8, more preferably 7.3 to 7.5. Adjusting the pH value of the nicotine liquid formulation to that range, is found to enhance the sensorial experience of the nicotine liquid formulation especially when used with tobacco flavours or flavours having a significant tobacco flavour component and also especially when used with creamy or milky flavours or flavours having a significant milky and/or creamy component.

The nicotine liquid formulation according to the second aspect of the invention can further implement all preferred embodiments of the first aspect of the invention, in particular with regard to the nicotine concentration, the carboxylic acids and the molar ratio of the primary acid or the mixture of primary acids to the nicotine. Further the nicotine liquid formulation according to the second aspect of the invention can comprise a secondary acid in combination with the primary acid.

Adding at least one secondary acid in combination with the primary acid or mixture of primary acids, allows for an easier and more accurate adjustment and control of the pH value of the nicotine liquid formulation.

That is, the nicotine liquid formulation according to the second aspect comprises a primary acid or a mixture of primary acids. The primary acid is preferably an organic acid. The primary acid or mixture of primary acids comprises at least a carboxylic acid. The carboxylic acid is not particularly restricted and a person skilled in the art can use any carboxylic acid suitable for use in a nicotine liquid formulation. Preferably the carboxylic acid is at least one acid selected from the list consisting of Benzoic acid, Levulinic acid, D/L-Tartaric acid, Capric acid, Pyruvic acid, Citric acid, Fumaric acid, D/L-Lactic acid, D/L-Malic acid, Sorbic acid, Adipic acid, L-Aspartic acid, L-Glutamic acid, Succinic acid, Gluconic acid, Linoleic acid, Saccharic acid, 3,7 dimethyl-6-octenoic acid, 2-methyl pentanoic acid, trans-2-Hexenoic acid, Caprylic acid, Lauric acid, Stearic acid, Butyric acid, Linolenic acid, Malonic acid, Myristic acid, Oleic acid, Palmitic acid, Phenylacetic acid, Propionic acid, Valeric acid, Decanoic acid, Hexanoic acid, Octanoic acid. More preferably the carboxylic acid is at least one acid selected from the list consisting of Benzoic acid, Levulinic acid, DL-Tartaric acid, Capric acid, Pyruvic acid, Citric acid, Fumaric acid, DL-Lactic acid, DL-Malic acid, Sorbic acid, Adipic acid, L-Aspartic acid, L-Glutamic acid, Succinic acid, Gluconic acid, Linoleic acid, Saccharic acid, 3,7 dimethyl-6-octenoic acid, 2-methyl pentanoic acid, trans-2-Hexenoic acid.

The nicotine concentration in the nicotine liquid formulation is 12 mg/ml or above. The nicotine liquid formulation has preferably a nicotine concentration in the range of 12 mg/ml to 40 mg/ml, preferably 12 mg/ml to 35 mg/ml, more preferably 12 mg/ml to 30 mg/ml, more preferably 12 mg/ml to 25 mg/ml, more preferably 12 mg/ml to 20 mg/ml, even more preferably 12 mg/ml to 19 mg/ml, even more preferably 12 mg/ml to 18 mg/ml, most preferably 18 mg/ml.

The molar ratio of the primary acid or mixture of primary acids to the nicotine in the nicotine liquid formulation is in the range of 0.5:1.0 to 0.85:1.0. Preferably, the molar ratio of the primary acid or mixture of primary acids to the nicotine in the nicotine liquid formulation is in the range of 0.55:1.0 to 0.8:1.0, more preferably 0.6:1.0 to 0.75:1.0, even more preferably 0.65:1.0 to 0.7:1.0. By adjusting the molar ratio of the primary acid or mixture of primary acids to the nicotine in the nicotine liquid formulation to said range the nicotine base is not completely neutralized by the acid, but there is still free nicotine base remaining in the nicotine liquid formulation. As a result, it is possible to provide a nicotine liquid formulation with enhanced sensorial experience providing an improved taste satisfaction with less bitter taste and with an improved throat sensation and nicotine impact. Further, it is possible to provide a nicotine liquid formulation that can be used universally with different devices, thereby avoiding the risk of adversely affecting the devise by the nicotine liquid formulation, in particular minimizing the risk that free acid reacts negatively with any components in a device which can be adversely affected by acidic liquids.

The nicotine liquid formulation comprises nicotine and a primary acid or mixture of primary acids in a liquid carrier. The liquid carrier is not further limited and any suitable medium in which the other compounds of the nicotine liquid formulation are soluble at ambient conditions, can be used. Examples include, but are not limited to, glycerol, propylene glycol, trimethylene glycol, water, ethanol and the like, as well as combinations thereof. In some embodiments, the liquid carrier comprises 0% to 100% of propylene glycol and 100% to 0% of glycerol, preferably vegetable glycerol. In some embodiments, the liquid carrier comprises 0% to 100% of propylene glycol and 100% to 0% of glycerol. In some embodiments, the liquid carrier comprises 10% to 70% of propylene glycol and 90% to 30% of glycerol. In some embodiments, the liquid carrier comprises 20% to 50% of propylene glycol and 80% to 50% of glycerol. In some embodiments, the liquid carrier comprises 30% propylene glycol and 70% glycerol. Preferably, the glycerol used is vegetable glycerol.

In a preferred embodiment the liquid carrier is formed of vegetable glycerol or a mixture of vegetable glycerol and propylene glycol, most preferably in any ratio of glycerol to propylene glycol from 100:0 to 40:60. The liquid carrier is preferably a mixture of vegetable glycerol and propylene glycol in a mixture of 100:0, more preferably 90:10, even more preferably 80:20, even more preferably 70:30 and even more preferably 60:40, even more preferably 50:50 and most preferably and 40:60.

Additionally, the nicotine liquid formulation can comprise water. For example, because of the hygroscopic nature of e.g. glycerol the solution may contain small amounts of water absorbed from the atmosphere, e.g. up to about 5 wt. %, more likely between 1-3 wt. %.

In some embodiments of the nicotine liquid formulation the primary acid or the mixture of primary acids is a mixture which comprises a primary acid, which is preferably an organic acid, most preferably a carboxylic acid and further comprises a secondary acid or a mixture of secondary acids.

The secondary acid or mixture of secondary acids is not particularly restricted and a person skilled in the art can use any acid suitable for the use in a nicotine liquid formulation. Preferably, the secondary acid or mixture of secondary acids is or includes an organic acid. Moreover, the secondary acid or mixture of secondary acids may be or include an inorganic acid such as phosphoric acid provided it is used in only relatively small concentrations relative to the primary acid or mixtures of primary acids (i.e. less than 10% by weight compared to the weight of the primary acid or mixture of primary acids).

The secondary acid or mixture of secondary acids is not particularly restricted and a person skilled in the art can use any acid suitable for the use in a nicotine liquid formulation. Preferably, the secondary acid or mixture of secondary acids is or includes an organic acid. Furthermore, the secondary acid or mixture of secondary acids may be or include a inorganic acid such as phosphoric acid if it is commonly used in food products and is therefore suitable for human consumption, provided that the total amount of such inorganic acid is relatively small compared to the amount of the primary acid or mixture of primary acids, e.g. less than 50% by volume of the amount of primary acid or mixture of primary acids and more preferably less than 20% and most preferably less than 10% compared with the amount of the primary acid or mixture of primary acids.

Preferably, the secondary acid or mixture of secondary acids is at least one acid selected from the group consisting of Benzoic acid, Levulinic acid, DL-Tartaric acid, Caprylic acid, Caproic acid, Capric acid, Lauric acid, Stearic acid, Pyruvic acid, Citric acid, Acetic acid, Oxalic acid, Butyric acid, Fumaric acid, DL-Lactic acid, Phosphoric acid, DL-Malic acid, Sorbic acid, Adipic acid, Ascorbic acid, L-Aspartic acid, L-Glutamic acid, Formic acid, Succinic acid, Gluconic acid, Linolenic acid, Linoleic acid, Malonic acid, Myristic acid, Oleic acid, Palmitic acid, Phenylacetic acid, Propionic acid, Saccharic acid, Salicylic acid, Valeric acid. Most preferably, the secondary acid or mixture of secondary acids is at least one acid selected from the group consisting of Stearic acid, Fumaric acid, Adipic acid, L-Aspartic acid, Gluconic acid, Linolenic acid, Linoleic acid, Malonic acid, Saccharic acid, Salicylic acid.

Adding one or more secondary acids to the primary used acid can provide an enhanced sensorial satisfaction for certain flavours or flavour-types of e-liquid formulation. This can be flavour dependent and in particular different secondary acids are useful with different flavours or flavour types. For example, the use of citric acid as a secondary acid is found to be particularly beneficial when used with fruit flavours or flavours including a significant fruit flavour component.

In an exemplary embodiment at least one secondary acid selected from the group comprising levulinic acid, oxalic acid, butyric acid, and tartaric acid is added to a nicotine liquid formulation in addition to the main carboxylic acid to enhance sensorial satisfaction of the nicotine liquid formulation. The use of these secondary acids is found to be particularly useful with tobacco flavours and flavours which include a significant tobacco flavour component.

In a further exemplary embodiment, at least one secondary acid selected from the group comprising citric acid, acetic acid, ascorbic acid, tartaric acid, fumaric acid, lactic acid and malic acid is added to the nicotine liquid formulation in addition to the main carboxylic acid to enhance sensorial satisfaction of the nicotine liquid formulation. The use of these secondary acids is found to be particularly beneficial when used with fruit flavours and flavours which include a significant fruit flavour component.

In a particular preferred embodiment, the nicotine liquid formulation according to the second aspect comprises in addition to the carboxylic acid at least one secondary acid selected from the group comprising citric acid, acetic acid, ascorbic acid, tartaric acid, fumaric acid, lactic acid and malic acid and further has a pH value in the range from 6 to 7, preferably 6.2 to 6.8, more preferably 6.3 to 6.5. Adding at least one of the secondary acids from the above list and adjusting the pH value of the nicotine liquid formulation to the above defined range, provides a nicotine liquid formulation with a particular enhanced sensorial experience, especially when used in e-liquid formulations having a fruit flavour or a significant fruit flavour component.

In a further exemplary embodiment, at least one secondary acid selected from the group comprising linolenic acid, linoleic acid and tartaric acid is added to the nicotine liquid formulation in addition to the primary acid or mixture of primary acids to enhance sensorial satisfaction of the nicotine liquid formulation. The secondary acid or mixture of secondary acids is added in an amount so that the weight ratio of the total amount of the secondary acid(s) to the total amount of the primary acid or mixture of primary acids is preferably about 0.1:0.9 to 0.5:0.5, more preferably from about 0.1:0.9 to 0.4:0.6, even more preferably from about 0.2:0.8 to 0.3:0.7, most preferably about 0.2:0.8.

The inventors of the present invention have found out that adding secondary acids such as linolenic acid, linoleic acid and/or tartaric acid to the primary acid or mixture of primary acids, in particular at a weight ratio of about 0.2:0.8, surprisingly enhances the taste satisfaction of tobacco flavour nicotine liquid formulations having a nicotine concentration of 12 mg/ml and above.

Adding secondary acids such as adipic acid and/or salicylic acid to the primary acid or mixture of primary acids surprisingly enhances the taste satisfaction of menthol flavour nicotine liquid formulations.

Adding secondary acids such as saccharic acid, malonic, and/or gluconic acid to the primary acid or mixture of primary acids surprisingly enhances the taste satisfaction of fruity and dessert-like flavour nicotine liquid formulations.

Adding at least one secondary acid to the primary acid provides nicotine liquid formulations with different taste and aroma notes thereby providing enhanced sensorial experience and improved taste satisfaction and flavour experience.

Furthermore, adding at least one secondary acid in combination with the primary acid or mixture of primary acids, allows for an easier and more accurate adjustment and control of the pH value of the nicotine liquid formulation.

In another particular preferred embodiment, the nicotine liquid formulation according to the second aspect comprises in addition to the carboxylic acid at least one secondary acid selected from the group comprising levulinic acid, oxalic acid, butyric acid, and tartaric acid and further has a pH value in the range from 7 to 8, preferably 7.2 to 7.8, more preferably 7.3 to 7.5. Adding at least one of the secondary acids from the above list and adjusting the pH value of the nicotine liquid formulation to above defined range, provides a nicotine liquid formulation with a particular enhanced sensorial experience especially when used in e-liquid formulations having a tobacco flavour or a significant tobacco flavour component, or when used in e-liquid formulations having a creamy or milky flavour or a significant creamy or milky flavour component.

The nicotine liquid formulations described herein can comprise other suitable components used for nicotine liquid formulations, such as flavourants, carriers, stabilizers, diluents, dispersing agents, suspending agents, thickening agents, and/or excipients.

Electronic Cigarette Cartridge

A third aspect of the present invention provides an electronic cigarette cartridge comprising a nicotine liquid formulation according to the first or second aspect.

The electronic cigarette cartridge can be any cartridge suitable to be used with an electronic cigarette. The electronic cigarette cartridge comprises a fluid storage compartment, wherein the fluid storage compartment stores a nicotine salt liquid formulation according to the first or second aspect of the invention.

Use of the Nicotine Liquid Formulation or Electronic Cigarette Cartridge

A fourth aspect of the present invention provides a use of the nicotine liquid formulation according to the first or second aspect or the electronic cigarette cartridge according to the third aspect in an electronic cigarette.

Electronic Cigarette

A fifth aspect of the present invention provides an electronic cigarette comprising the nicotine liquid formulation according to the first or second aspect or the electronic cigarette cartridge according to the third aspect.

The electronic cigarette according to the fifth aspect of the present invention can be any type of electronic cigarette a skilled person knows.

In general, the term "electronic cigarette" or "e-cigarette" or "low temperature vaporization device", refers to an electronic inhaler that vaporizes a liquid solution into an aerosol mist, simulating the act of tobacco smoking. In general, an electronic cigarette contains four main components: a mouthpiece, a reservoir for liquid, an atomizer that vaporizes the liquid, and a battery. The reservoir stores the nicotine liquid formulation.

In the electronic cigarette according to the fifth aspect of the invention the reservoir stores the nicotine liquid formulation according to the first or second aspect of the present invention. The reservoir may be replaceable or not. In a specific embodiment of the electronic cigarette according to the fifth aspect of the present invention the electronic cigarette comprises an electronic cigarette cartridge according to the third aspect of the invention and the electronic cigarette cartridge forms the reservoir of the electronic cigarette.

Other components of the electronic cigarettes may include a combined atomizer and reservoir that may or may not be disposable, a mouthpiece that may be integrated with the combined atomizer and reservoir or not, and a battery.

The vaporizer of the electronic cigarette is not further restricted and can implement different techniques. Exemplary embodiments of the vaporizer are an induction heated device, a light heated device, or an electrically heated device. The induction heated device includes a generator for generating an alternating electromagnetic field and one or more susceptors which generate heat used to vaporize the nicotine liquid formulation when energized by the generated alternating electromagnetic field. The light heated device uses a light source such as a laser or high-power LED directing light to an absorber element which is heated by the light absorbed from the light source in order to vaporize the nicotine liquid formulation. In the electrically heated device a heat transfer element absorbs heat from an electrical heater and transfers it to a wick for vaporization of the e-liquid.

Method of Generating an Inhalable Aerosol

A sixth aspect of the present invention provides a method of generating an inhalable aerosol comprising nicotine for delivery to a user comprising using an electronic vaporization device comprising a nicotine liquid formulation and a heater, wherein the nicotine liquid formulation is a nicotine liquid formulation according to the first or second aspect, the method comprising (i) providing an amount of the nicotine liquid formulation to the heater; and (ii) forming an aerosol by heating the amount of the nicotine liquid formulation.

The method of generating an inhalable aerosol comprising nicotine for delivery to a user comprising using an electronic vaporization device. The electronic vaporization device is not further restricted. Preferably the electronic vaporization device is an electronic cigarette according to the fifth aspect of the present invention.

Mousse Comprising a Tobacco Ingredient

A seventh aspect of the present invention provides a mousse comprising a tobacco ingredient containing agent and/or an inhalable agent, an aerosol forming agent, a foam stabilizing agent, and a foam forming agent, wherein the weight of the tobacco ingredient containing agent and/or the inhalable agent is 0.1-33 wt.-% of the weight of the foam, and the weight of the aerosol forming agent is 10-70 wt.-% of the weight of the foam, wherein the tobacco ingredient containing agent and/or an inhalable agent includes a nicotine liquid formulation according to the first or second aspect of the present invention.

That is, the nicotine liquid formulation according to the first or second aspect of the present invention can be used as a is used as tobacco ingredient containing agent and/or an inhalable agent in a mousse/foam as know for a skilled person and describes in WO 2018/122375 A1, which is hereby incorporated by reference.

Consumable Item Comprising a Non-Woven Fibrous Material

An eighth aspect of the present invention provides a consumable item comprising a non-woven fibrous material (e.g. paper made from cellulose fibers or reconstituted tobacco fibers), wherein the non-woven fibrous material includes a nicotine liquid formulation according to the first or second aspect of the present invention.

In one embodiment the consumable item is in the form of a pod, preferably comprising an outer shell or wrapping formed of paper or plastic and preferably being pierceable to permit an airflow to flow through the pod.

In another embodiment the consumable item is in the form of a rod having a paper wrapping and including a mouthpiece formed from a filter, such as a center hold filter or an acetate filter.

In any of the consumable items as described above the fibrous material is preferably formed by generating a fibrous material by processing cellulose fibers and or tobacco fibers to make a sheet (e.g. by forming a slurry of fibers and then pressing the slurry) and then adding a nicotine liquid formulation according to any one of claims 1-11.

EXAMPLES

Measurement of the pH Value

To measure the pH value of the nicotine liquid formulations according to the invention the nicotine liquid formulation is diluted with 10% by weight of water prior to measuring the pH value. All pH values referred to within this description are measured according to said method.

Assessing the Sensorial Experience of Nicotine Liquid Formulations

To assess the sensorial experience of nicotine liquid formulations in an objective manner a standard method for the assessment of flavors and fragrances has been used. The assessment of the sensorial effect used the methodology of Quantitative Descriptive Analysis (QDA™). Through this method, the sensory characteristics of all of the products were determined by a trained sensory panel. The panel used had been selected on the basis of their sensory acuity and descriptive ability.

The assessors initially generated a vocabulary list to best describe the samples to include initial impact, during vaping and after vaping modalities. The discussion regarding differences and similarities between the samples was facilitated by a panel leader whose role was to ensure there was consensus within the group for each attribute and their corresponding definition (see the sensory attributes list in Table 1).

The panel practiced scoring these different attributes by evaluating the samples to determine which was higher in the particular attribute evaluated.

The samples were then rated against this vocabulary, on an individual basis and according to a balanced experimental design, which minimizes bias due to sample presentation order. Evaluation for the QDA was conducted in triplicate using an unstructured line scale with no anchor points.

Results were collected via a data capture system and analyzed using Analysis Of Variance (ANOVA).

Time points evaluated are as indicated below:

Time Points:

0-1 min (Initial Impact)

2-5 min (During Vaping)

Break in between samples: 5 minutes

Flavour Satisfaction Equation:

Flavour satisfaction=Overall Flavour+Complexity of Taste+Perceived Nicotine Strength−(Bitter+Off-taste+Mouth/Nose/throat scratching)

TABLE 1

Sensory Attributes list

| Attribute | Description | Scale |
|---|---|---|
| Initial Throat Sensation | Measure the feeling you get in the back of your throat and chest when you inhale vapour for the first vape | Not to Very |
| Vapour Volume | Measure the amount of vapour perceived in the mouth when inhaling and exhaling | Not to Very |
| Overall Flavour | Measure of an overall perception of the flavour intensity (of any kind) | Not to Very |
| Tobacco | Measure of flavour associated with tobacco (like Golden Virginia, Old Holborn or Amber leaf) | Not to Very |
| Bitter | Measure of bitter taste perceived on tongue, like in coffee | Not to Very |
| Off-Taste | Measure of any kind of unwanted bad notes perceived including plastic notes | Not to Very |
| Complexity of taste | More than one dominant taste component mingling with each other | Not to Very |
| Mouth/Nose/Throat scratching | Measure of a tingling, prickling and/or scratching sensation perceived on the lips, tongue or back of the throat from none which is smooth to very which is harsh | Smooth to Harsh |
| Perceived Nicotine Strength | Perceived level of nicotine in the product | Not to Very |

Results

A sensory research using the QDA™ method was run to assess the sensory impact of different molar ratio of benzoic acid to nicotine in tobacco flavor e-liquids at 18 mg/ml. E-liquids with and without benzoic acid were also compared to the same tobacco flavor e-liquid at 12 mg/ml.

Sensory Test Objective:

The following QDA™ was to understand the sensory differences between the e-liquids at 18 mg/ml with benzoic acid at three different molar ratios (0.5:1; 0.7:1 and 1:1) and the standard sample of tobacco flavor e-liquid at 18 mg/ml.

The objective of the study was therefore to determine which of the three formulations combined:

Reduced bitterness level in taste and aftertaste

Reduced nose and throat irritation level.

Improved initial throat sensation.

Increased perceived nicotine strength and impact

Increased tobacco flavor and aftertaste

The tobacco flavor e-liquid at 12 mg/ml was also introduced into the test as another comparative reference.

Trials were formulated to achieve different nicotine strength and different molar ratio of acid to nicotine at 18 mg/ml as summarized in the Table 2 below.

TABLE 2

Overview of the samples

| Sample ID | JTG | Name | Nicotine conc. (mg/ml) | PG/G | Molar ratio BA:nicotine | Acid | Device |
|---|---|---|---|---|---|---|---|
| 1 | JTG | Tobacco | 18 (CLP) | 30/70 | 1:1 | Yes, BA | Logic Compact UK |
| 2 | JTG | Tobacco | 18 (CLP) | 30/70 | 0.75:1 | Yes, BA | Logic Compact UK |
| 3 | JTG | Tobacco | 18 (CLP) | 30/70 | n/a | no | Logic Compact UK |
| 4 | JTG | Tobacco | 12 | 30/70 | n/a | no | Logic Compact UK |

BA: Benzoic acid
PG: propylene glycol
G: glycerol

Results from ANOVA

TABLE 3

Comparisons between Trials. Summary of attributes mean scores for each e-liquids and of the significant differences.

| Attributes + significance symbol | Tobacco 12 mg/ml | Tobacco 18 mg/ml | Tobacco 18 mg/ml BA 0.5:1 | Tobacco 18 mg/ml BA 0.75:1 | Tobacco 18 mg/ml BA 1:1 | p-values |
|---|---|---|---|---|---|---|
| Initial Throat Sensation *** | 40.30 | 54.54 | 43.42 | 46.24 | 44.46 | 0.000 |
| Vapour Volume *** | 42.61 | 48.75 | 44.02 | 48.64 | 45.30 | 0.000 |
| Overall Flavour *** | 33.96 | 44.48 | 38.74 | 41.72 | 36.50 | 0.000 |
| Tobacco *** | 32.39 | 43.88 | 38.14 | 32.71 | 31.28 | 0.000 |
| Bitter** | 11.49 | 17.37 | 14.60 | 13.15 | 9.72 | 0.001 |
| Off-Taste** | 19.75 | 17.25 | 16.92 | 17.86 | 13.08 | 0.002 |
| Complexity of Taste*** | 27.81 | 28.22 | 26.02 | 25.81 | 26.26 | 0.000 |
| Mouth/Nose/ Throat Scratching *** | 34.04 | 49.81 | 41.42 | 35.61 | 29.10 | 0.000 |
| Perceived nicotine strength *** | 44.98 | 53.08 | 47.80 | 43.07 | 40.52 | 0.000 |
| Tobacco Aftertaste*** | 24.09 | 33.12 | 26.19 | 21.10 | 19.54 | 0.000 |

Comparison between Tobacco Flavour E-Liquid at 18 mg/ml with 1:1 Benzoic Acid:Nicotine and Tobacco E-liquid without Benzoic Acid at 18 mg/ml and 12 mg/ml The results show that the addition of benzoic acid at an equimolar ratio to the nicotine had a significant impact on the sensory profile which had a closer sensory profile to that of the same e-liquid at 12 mg/ml. Compared with the tobacco flavour e-liquid without benzoic acid at 18 mg/ml, the e-liquid with benzoic acid at 1:1 ratio had a lower initial throat sensation, lower overall flavour and lower tobacco flavour and aftertaste. It was less bitter and was perceived as less mouth, throat and nose scratching. However, compared to the 12 mg/ml e-liquid, the e-liquid with the equimolar ratio of benzoic acid to the nicotine had also lower perceived nicotine impact and lower tobacco aftertaste (see FIG. 1).

Figure 2:
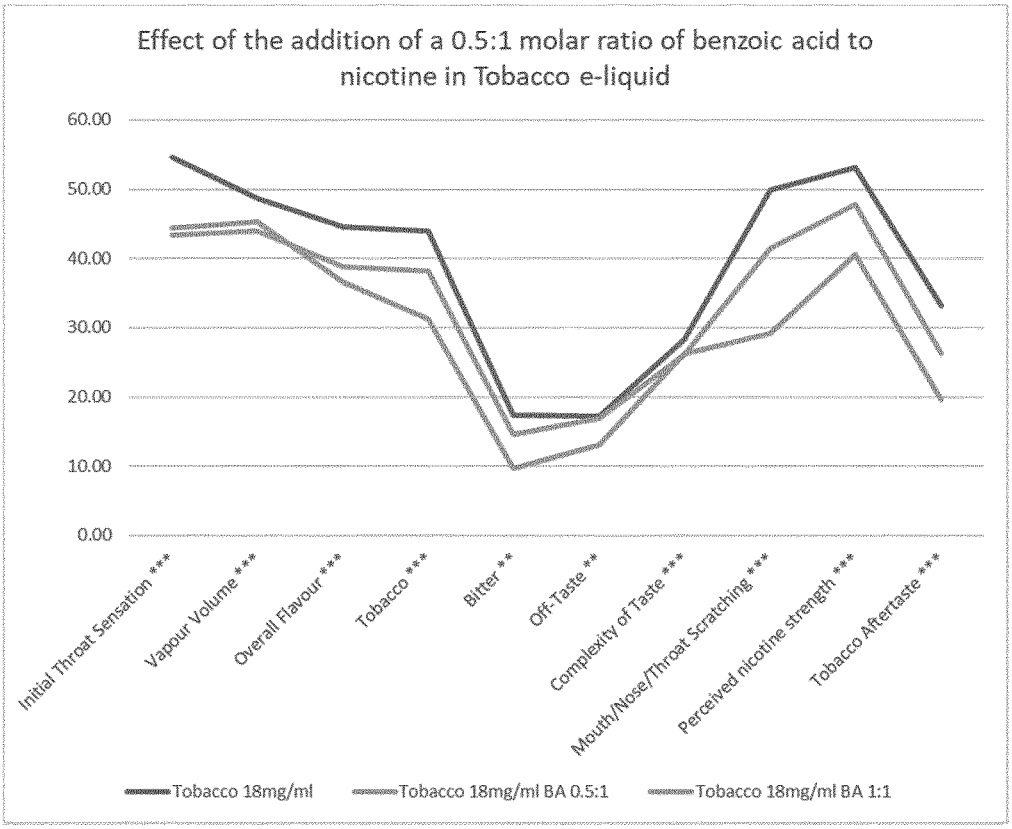
FIG. 2: Effect of benzoic acid (0.5:1 molar ratio acid to nicotine) on the sensory profile of tobacco flavor e-liquid at 18 mg/ml

Comparison between Tobacco Flavour E-Liquid at 18 mg/ml with 1:1 and 0.5:1 Benzoic Acid:Nicotine and Tobacco E-Liquids without Benzoic Acid at 18 mg/ml In a similar way to the e-liquid with 1:1 ratio of benzoic acid, the e-liquid with reduced molar ratio 0.5:1 retained relatively lower bitterness and mouth, throat nose scratching sensation than the e-liquid at 18 mg/ml without benzoic acid. However, compared to the 1:1 formulation, the 0.5:1 formulation had similar initial impact, more perceived tobacco flavor and aftertaste and higher perceived nicotine strength and impact (see FIG. 2).

Figure 3:
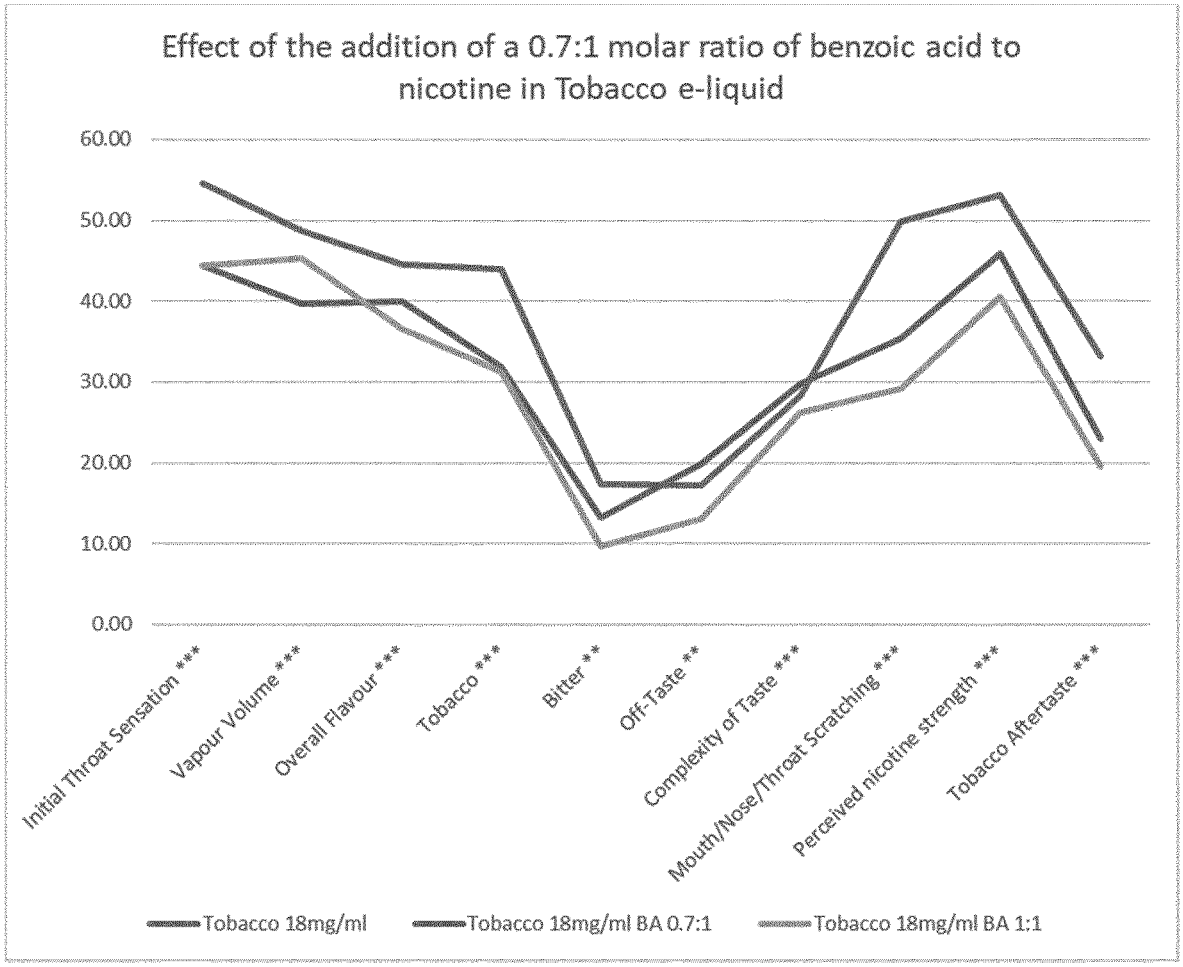
FIG. 3: Effect of benzoic acid (0.70:1 molar ratio acid to nicotine) on the sensory profile of tobacco flavor e-liquid at 18 mg/ml
Figure 4:
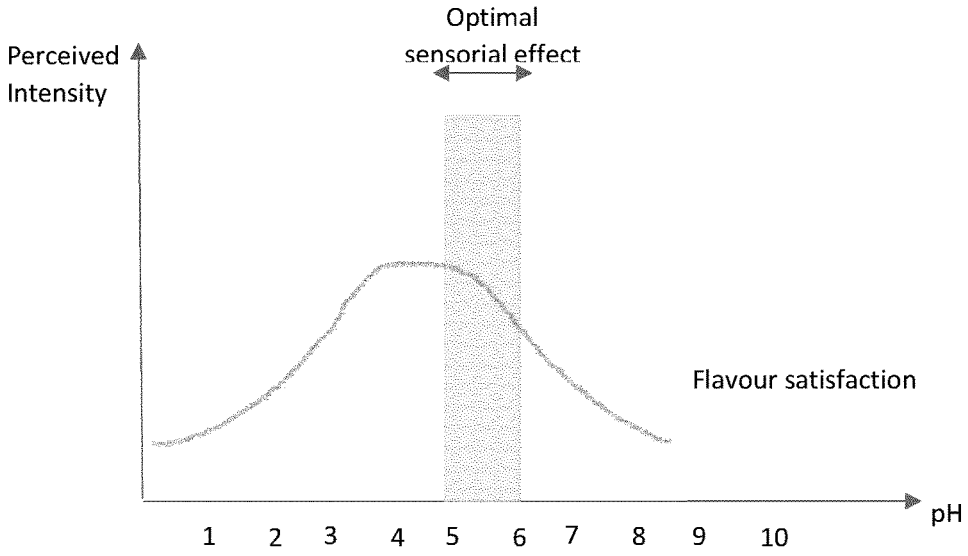
FIG. 4: Perceived flavour satisfaction according to e-liquid pH
Figure 5:
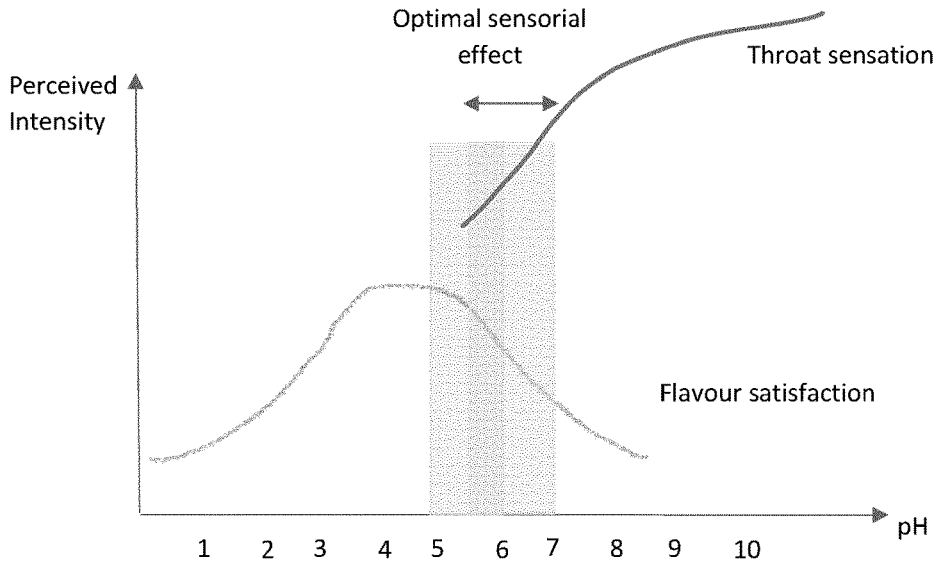
FIG. 5: Perceived flavour satisfaction and throat sensation according to e-liquid pH in presence of free base nicotine
Figure 6:
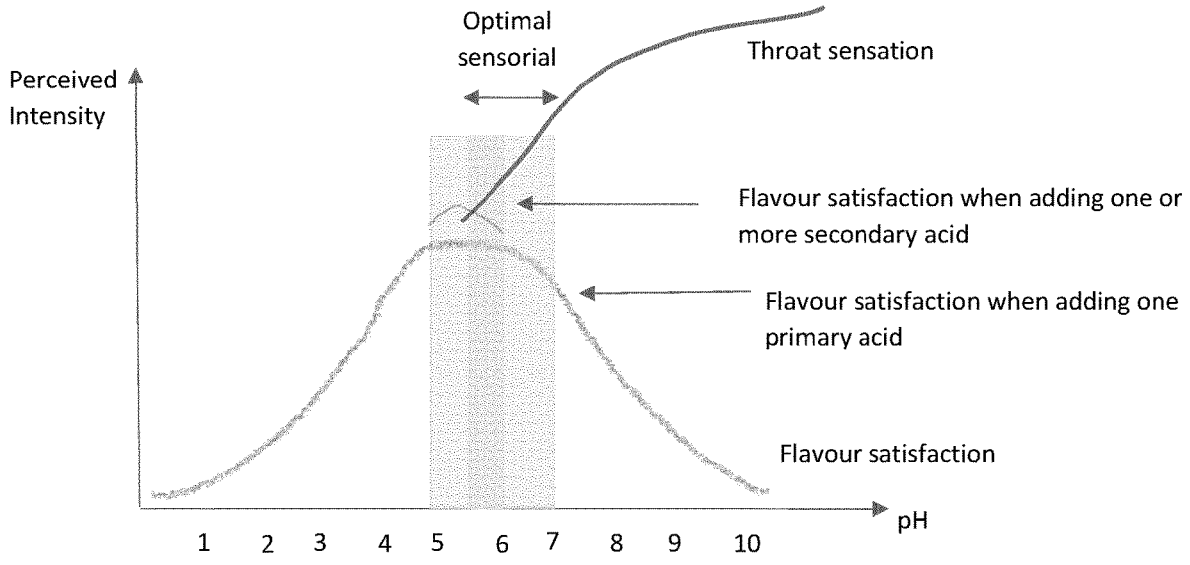
FIG. 6: Enhancement of perceived flavour satisfaction when using mix of acids in e-liquid

Comparison between Tobacco Flavour E-Liquid at 18 mg/ml with 1:1 and 0.7:1 Benzoic Acid:Nicotine and Tobacco E-Liquids without Benzoic Acid at 18 mg/ml Similarly, to the e-liquid with 1:1 ratio of benzoic acid, the e-liquid with a reduced molar ratio of acid to nicotine of 0.70:1 retained relatively lower bitterness and scratching sensation in the mouth, nose and throat than the e-liquids at 18 mg/ml without benzoic acid. However, compared to the 1:1 formulation, the 0.70:1 formulation had higher complexity of taste with aromatic flavor notes complementing the overall flavor and aftertaste and with slightly perceived nicotine strength (see FIG. 3).

Conclusion

TABLE 4

| Sample | Recommendation |
|---|---|
| 1. Current e-liquid 18 mg/gl without benzoic acid | standard |
| 2. Trial 1-with benzoic acid 1:1 | approved |
| 3. Trial 2- with benzoic acid 0.5:1 | approved |
| 3. Trial 3: with benzoic acid 0.75:1 | approved |

The three trial samples were similar and met most of the flavour objective. However, Trial 1:1 was the lowest in initial throat sensation, overall flavor, tobacco flavor and aftertaste and complexity of taste. Both reduced molar ratio formulation had a sensory profile with same levels of low bitterness as the 1:1 formulation but with slightly higher initial throat sensation, perceived nicotine strength and impact. These sensory attributes have been found as positive drivers of liking for adult smokers.

The invention claimed is:

1. A nicotine liquid formulation comprising nicotine and a primary acid or a mixture of primary acids in a liquid carrier, wherein a nicotine concentration in the nicotine liquid formulation is from 12 mg/ml to 18 mg/ml, the primary acid or the mixture of primary acids comprises at least Benzoic acid, a molar ratio of the primary acid or the mixture of primary acids to the nicotine in the nicotine liquid formulation is in a range of 0.5:1.0 to 0.75:1.0, and wherein the nicotine liquid formulation includes free-base nicotine.

2. The nicotine liquid formulation according to claim 1, wherein the nicotine liquid formulation comprises the mixture of primary acids further including at least one carboxylic acid selected from the group of Levulinic acid, D/L-Tartaric acid, Capric acid, Pyruvic acid, Citric acid, Fumaric acid, D/L-Lactic acid, D/L-Malic acid, Sorbic acid, Adipic acid, L-Aspartic acid, L-Glutamic acid, Succinic acid, Gluconic acid, Linoleic acid, Saccharic acid, 3,7 dimethyl-6-octenoic acid, 2-methyl pentanoic acid, trans-2-Hexenoic acid, Caprylic acid, Lauric acid, Stearic acid, Butyric acid, Linolenic acid, Malonic acid, Myristic acid, Oleic acid, Palmitic acid, Phenylacetic acid, Propionic acid, Valeric acid, Decanoic acid, Hexanoic acid, and Octanoic acid.

3. The nicotine liquid formulation according to claim 1, further comprising a secondary acid or a mixture of secondary acids.

4. The nicotine liquid formulation according to claim 3, wherein the secondary acid or the mixture of secondary acids is at least one acid selected from the group of Caproic acid, Acetic acid, Oxalic acid, Phosphoric acid, and Salicylic acid.

5. The nicotine liquid formulation according to claim 3, wherein an amount of the secondary acid or the mixture of secondary acids is less than 50% by volume of an amount of the primary acid or the mixture of primary acids.

6. The nicotine liquid formulation according to claim 1, wherein the liquid carrier is formed of vegetable glycerol or a mixture of vegetable glycerol and propylene glycol.

7. The nicotine liquid formulation according to claim 1, wherein the molar ratio of the primary acid or the mixture of primary acids to the nicotine in the nicotine liquid formulation is in a range of 0.6:1.0 to 0.75:1.0.

8. An electronic cigarette cartridge comprising the nicotine liquid formulation according to claim 1.

9. An electronic cigarette comprising the electronic cigarette cartridge according to claim 8.

10. An electronic cigarette comprising the nicotine liquid formulation according to claim 1.

11. A method of generating an inhalable aerosol comprising nicotine for delivery to a user, the method comprising:

using an electronic vaporization device comprising the nicotine liquid formulation according to claim 1 and a heater, wherein the step of using comprises:

(i) providing an amount of the nicotine liquid formulation to the heater; and (ii) forming an aerosol by heating the amount of the nicotine liquid formulation.

12. A mousse comprising a tobacco ingredient containing agent and/or an inhalable agent, an aerosol forming agent, a foam stabilizing agent, and a foam forming agent, wherein a weight of the tobacco ingredient containing agent and/or the inhalable agent is 0.1-33 wt.-% of a weight of the foam, and a weight of the aerosol forming agent is 10-70 wt.-% of the weight of the foam, wherein the tobacco ingredient containing agent and/or the inhalable agent includes the nicotine liquid formulation according to claim 1.

13. A consumable item comprising a non-woven fibrous material including the nicotine liquid formulation according to claim 1 in the non-woven fibrous material.

14. The consumable item according to claim 13 in the form of a pod comprising an outer shell or wrapping formed of paper or plastic and being pierceable to permit airflow to flow through the pod.

15. The consumable item according to claim 13 in the form of a rod having a paper wrapping and including a mouthpiece formed from a filter.

16. The consumable item according to claim 13 wherein the non-woven fibrous material is a fibrous material including cellulose fibers and/or tobacco fibers.

17. A nicotine liquid formulation comprising nicotine and a primary acid or a mixture of primary acids in a liquid carrier, wherein a nicotine concentration in the nicotine liquid formulation is from 12 mg/ml to 18 mg/ml, the primary acid or the mixture of primary acids comprises at least Benzoic acid, the nicotine liquid formulation has a pH value in a range from 6.2 to 6.8 or from 7.2 to 7.8, and wherein the nicotine liquid formulation includes free-base nicotine.

18. The nicotine liquid formulation according to claim 17, wherein the pH value of the nicotine liquid formulation is in the range from 6.2 to 6.8.

19. The nicotine liquid formulation according to claim 17, wherein the pH value of the nicotine liquid formulation is in the range from 7.2 to 7.8.

* * * * *